US008629884B2

(12) United States Patent
Glen

(10) Patent No.: US 8,629,884 B2
(45) Date of Patent: Jan. 14, 2014

(54) WIDE COLOR GAMUT DISPLAY SYSTEM

(75) Inventor: David I. J. Glen, Toronto (CA)

(73) Assignee: ATI Technologies ULC, Markham, Ontario (CA)

( * ) Notice: Subject to any disclaimer, the term of this patent is extended or adjusted under 35 U.S.C. 154(b) by 1186 days.

(21) Appl. No.: 11/952,589

(22) Filed: Dec. 7, 2007

(65) Prior Publication Data

US 2009/0147021 A1 Jun. 11, 2009

(51) Int. Cl.
*G09G 5/02* (2006.01)

(52) U.S. Cl.
USPC ..... 345/603; 345/604; 345/522; 348/558; 348/599; 348/604; 348/661

(58) Field of Classification Search
USPC ..... 348/604
See application file for complete search history.

(56) References Cited

U.S. PATENT DOCUMENTS

| | | | |
|---|---|---|---|
| 5,124,688 | A | 6/1992 | Rumball |
| 5,838,299 | A | 11/1998 | Smith et al. |
| 5,872,556 | A | 2/1999 | Rackley et al. |
| 5,920,340 | A | 7/1999 | Man et al. |
| 5,936,683 | A | 8/1999 | Lin |
| 6,025,885 | A | 2/2000 | Deter |
| 6,157,415 | A | 12/2000 | Glen |
| 6,268,847 | B1 | 7/2001 | Glen |
| 6,314,479 | B1 | 11/2001 | Frederick et al. |
| 2010/0033627 | A1 | 2/2010 | Hayashi et al. |

FOREIGN PATENT DOCUMENTS

| | | |
|---|---|---|
| JP | 2002-330296 | 11/2002 |
| WO | 2007026126 A1 | 3/2007 |

OTHER PUBLICATIONS

Gordon, B.; "A low-power multiplierless YUV to RGB converter based human vision perception"; Oct. 1994; IEEE; pp. 408-417.
Desor, H.-J.; "Single-chip video processing system"; Aug. 1991; IEEE; pp. 182-189.
International Search Report for International Application No. PCT/CA2008/001891; from Canadian Patent Office; dated Jan. 27, 2009.
Sugiura, Hiroaki et al.; Wide Color Gamut Displays Using LED Backlight—Signal Processing Circuits, Color Calibration System and Multi-Primaries; IEEE International Conference; Sep. 11, 2005; pp. 1-4.
Chinese Office Action; Chinese Application No. 200880126105.4; dated Aug. 24, 2012.
Japanese Office Action; Japanese Appl. No. 2010-536292; dated Jan. 9, 2013.
High-Definition Multimedia Interface Specification Version 1.3; Jun. 22, 2006; p. iii, pp. 97-98 and pp. 146-152.
Asakura, Reiji; Something Wicked This Way Comes! vol. 39; HiVi; Stereo Sound Publishing Inc.; Nov. 20, 2006; vol. 24 No. 11; pp. 104-107.
Chinese Office Action; Chinese Appl. No. 200880126105.4; dated Apr. 19, 2013.

*Primary Examiner* — Antonio A Caschera
(74) *Attorney, Agent, or Firm* — Faegre Baker Daniels LLP

(57) ABSTRACT

A wide gamut RGB digital display, such as an LCD display, digital television, printer, or any other suitable display, includes wide color gamut configuration message control logic that is operative to indicate, to an image source provider, wide gamut RGB indication information and wide color gamut format definition information that indicates that wide gamut RGB color data is to be received by the wide gamut RGB digital display. The wide gamut configuration message control logic is also operatively responsive to wide gamut confirmation information that is received from the image source provider. The wide gamut RGB digital display also includes logic that is operative to display received wide gamut RGB color data that was received in response to the wide gamut RGB indication information and the wide color gamut format definition information.

13 Claims, 3 Drawing Sheets

WIDE COLOR GAMUT DISPLAY SYSTEM

FIELD OF THE INVENTION

The disclosure describes apparatus and methods in the field of wide gamut RGB digital display systems and methods.

BACKGROUND OF THE INVENTION

Wide gamut RGB digital displays are known. For video applications such as digital televisions, the YCbCr color space was introduced and a high definition multimedia interface specification has been proposed to add support for the wide gamut version of the YCbCr color space. However, this specification works in the YCbCr color space but not in the RGB color space. Hereinafter, "wide gamut" will be used interchangeably with "wide gamut color" and "wide color gamut."

Some wide gamut displays can take standard gamut input data, either in RGB space or YCbCr space and do signal processing to expand the color value gamut. This results in images with unnatural colors as the gamut of the image input to the display was in a standard range. Other known RGB displays may, for example, receive rendered graphics information, for example, rendered in a 32 bit floating point space or a signed integer space and convert a video frame back into an 8 bit RGB format for display. Hereinafter, "standard" will be used interchangeably with "non-wide."

Other systems are known such that a host device provides wide gamut RGB information to a display and may include, for example, a graphics/video processing core (e.g., processor) that indicates wide gamut color values to the display. However, the display is not a wide gamut RGB digital display but instead provides a wider brightness dynamic range based on the wide gamut RGB color data. The display typically uses an 8 bit RGB color scheme color gamut. However, 14 or 16 bits of brightness are used per pixel. A user interface may be used to force the image system to indicate extended brightness values. However, such systems do not employ the wide gamut RGB digital displays and therefore in effect may suffer from a lower quality image.

Accordingly, a need exists for a display system and methods that employ full wide gamut RGB display operations through a type of wide gamut RGB interface.

BRIEF DESCRIPTION OF THE DRAWINGS

The invention will be more readily understood in view of the following description when accompanied by the below figures and wherein like reference numerals represent like elements, wherein.

DETAILED DESCRIPTION OF THE PREFERRED EMBODIMENTS

Figure 1:
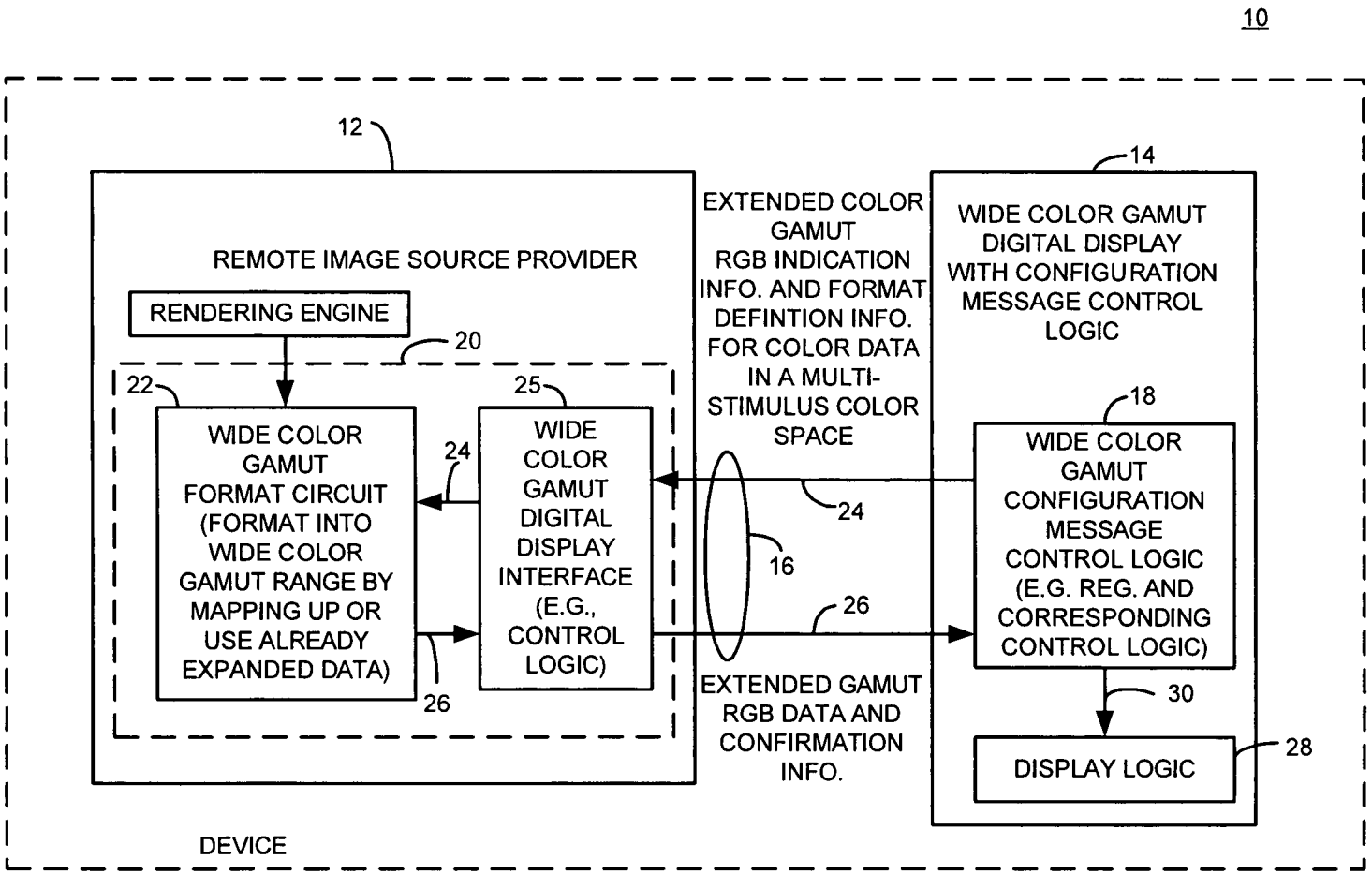
FIG. 1 is a block diagram illustrating one example of an image source provider that provides wide color gamut or extended gamut RGB data and confirmation information to a wide color gamut digital display.

Briefly, a wide gamut RGB digital display, such as an LCD display, digital television, printer, or any other suitable display, includes wide color gamut configuration message control logic that is operative to indicate, to an image source provider, wide gamut RGB indication information and wide color gamut format definition information that indicates that wide gamut RGB color data is to be received by the wide gamut RGB digital display. By way of example, this information may be sent across a link via a display interface or may be obtained from reading a local register in a display indicating a model number of a display, or in any other suitable manner. The wide gamut configuration message control logic is also operatively responsive to wide gamut confirmation information that is received from the image source provider. The wide gamut RGB digital display also includes logic that is operative to display received wide gamut RGB color data that was received in response to the wide gamut RGB indication information and the format definition information.

In one example, the wide color gamut configuration message control logic includes one or more registers containing data representing the wide color format definition information. Although described with respect to RGB information, any multi-stimulus color space may also be used such as another tri stimulus color space or any other suitable color space. An wide range of RGB values outside a normalized 0.0-1.0 range is, for example, sent from an image source generation unit to a wide gamut RGB digital display device. As such, the wide gamut RGB digital display notifies the image source provider that it can support wide gamut RGB image data. The wide gamut RGB digital display provides or implies details on the exact number format of the wide color values that it can display. The image source provider indicates to the wide gamut RGB digital display, when wide gamut RGB color data is being sent, so that the display can properly interpret this information. In one example, an explicit signal is sent by the display itself. In another example it is in an embedded signal or side band signal on a display interface.

In another example, a wide gamut RGB digital display includes wide color gamut configuration message control logic that indicates, to an image source provider, wide gamut RGB indication information indicating that wide gamut RGB color data is to be received in an wide multi-stimulus color space, such as RGB color space. The display also includes logic that displays received wide gamut RGB color data that was received in response to the wide gamut RGB indication information. As such, in this embodiment, wide color gamut format definition information is not communicated from the display to the image source provider but may be, for example, predefined if desired. Systems and methods are also disclosed that employ both a wide gamut RGB digital display and corresponding image source provider.

Among other advantages, image source providers that are capable of rendering wide gamut RGB images, for example, can now provide the wide gamut RGB images to a wide gamut RGB digital display in a suitable manner.

FIG. 1 illustrates one example of an image display system 10 such as, but not limited to, a digital television, a laptop computer and corresponding wide color gamut digital display, a printer, or any other suitable image display system. The image display system 10 includes an image source provider 12 which communicates with a wide gamut RGB digital display 14 via a suitable link 16 that can be a wireless link, a display interface link, or any other suitable communication link. The wide color gamut digital display 14 may be, for example, an LCD display, or any other suitable display that includes wide color gamut configuration message control logic 18. The image source provider 12 in this example will be described as a host image processing system that employs, for example, a video graphics processor and shown as 20 that includes wide color gamut format circuit 22 that is operative to format or generate wide color gamut RGB information by, for example, a mapping operation or utilizing already expanded data received from another subsystem or circuit within the image source provider 12. Logic or circuit as used herein may include one or more suitably programmed processors that executes computer readable instructions that are stored in memory, discrete logic, application specific integrated circuits, or any suitable combination of hardware, executing software and/or firmware as desired. The wide color gamut format circuit 22 may reformat from wide color gamut RGB from a graphics rendering engine to a format for a wide gamut RGB display when the source provider knows that a wide gamut display is connected (e.g., go from sRGB from renderer to scRGB for a display).

A wide color gamut digital display interface 25 is an interface between the wide color gamut digital display 14 and the wide color gamut format circuit 22.

The wide color gamut format circuit 22 may be in any suitable form including a suitably programmed processor that executes computer readable instructions that are stored in memory, discrete logic, application specific integrated circuits, or any suitable combination of hardware, software and firmware as desired. In this example, the wide color gamut format circuit 22 extends the color gamut of RGB values to a wider range of RGB values after normalization has occurred. This may be done, for example, by adding a sign bit and an implied decimal point to a fixed point number value of RGB values, or using an implied DC offset for fixed point unsigned values, or using floating point values or any suitable combination as desired. It is desirable to have an wide gamut RGB color data that has more than 8 bits per color value per RGB component, otherwise there can be a reduction of precision within the normalized 0.0-1.0 color range which could cause image artifacts on screen. As such, a mapping operation using, for example, using a lookup table, or a computation algorithm may be employed, or any suitable mechanism to generate wide color gamut information in a suitable format that is recognized by the wide color gamut digital display 14 as identified in information sent by the wide color gamut digital display 14. For example, the wide gamut RGB digital display 14 includes the wide color gamut configuration message control logic 18 that is operative to indicate to the image source provider 12, wide gamut RGB indication information and wide gamut color format definition information 24 that is used by the image source provider 12 to provide wide gamut RGB color data 26 that is provided in a multi-stimulus color space. The wide color gamut configuration message control logic 18 is responsive to wide gamut confirmation information that may be embedded with the wide gamut RGB data 26 or sent as separate information if desired which confirms to the wide color gamut digital display 14 that the sent wide gamut RGB color data 26 is in a suitable format for display. The wide color gamut configuration message control logic 18 may be discrete logic suitably programmed processor, ASIC, or any suitable combination of hardware, software and firmware that is executing.

The wide color gamut digital display 14 also includes display logic 28 that receives suitably processed wide gamut RGB color data 30 that was sent as the wide gamut RGB data 26 and processed further if desired and displays the received wide gamut RGB color data 26 in response to the wide gamut RGB indication information 24 and format definition information. The wide gamut RGB indication information 24 may be data representing an indication that the wide color gamut digital display 14 is capable of displaying not only standard color range RGB data, but also wide color gamut RGB color data.

The format definition information is data representing the format of the wide gamut RGB data 26 that the wide color gamut digital display 14 can display. For example, a certain number of bits and an ordering of the information to provide a suitable format may be required by the wide color gamut digital display 14 so that the image source provider 12 can use the wide color gamut format circuit 22 to suitably format the wide color gamut data from, for example, a sign bit and an implied decimal point configuration to a floating point value configuration. The format definition information may also indicate a desired range of values to use to represent the wide gamut color range. The base color chromaticity can also be defined by the format definition information. Two examples of ways of sending wide gamut RGB information, by the image source provider (e.g., logic therein) over a display interface are generating the wide gamut RGB information in a format that includes an altered color chromaticity value for a range defined for a nonwide gamut range and redefining the digital coding format, but keep the meaning of the "full scale" normalized color (1.0) and "no color" (0.0) the same. An example of the former is using an existing digital coding format for non-wide gamut information but the "meanings" of R, G & B chromaticity can be redefined. For example if the system is using 8, 10 or 12 bit unsigned integer with range 0 to (2 n)-1 where 0 is normalized to "no color" and (2 n)-1 to "full color", then the numbering format can be kept and the meaning of "full color" can be changed by altering the chromaticity of the color. This method is hinted at in HDMI 1.3, but does not appear to be fully enabled for RGB color spaces.

Another method of redefining the digital coding format, but keeping the meaning of the "full scale" normalized color (1.0) and "no color" (0.0) the same can also be used. If the digital color value goes outside this normalized range, then it indicates a color outside of this standard gamut range. For example a floating point coding system, or integer system with sign and/or implied decimal points could be used, or a coding system with a fixed DC offset to avoid the need for negative numbers (i.e., shift normalized 0.0 to some code value greater than 0) could be used. In one example, the wide color gamut confirmation message control logic includes a register and corresponding logic where the register contains data representing the wide color format definition information to be used. It will be recognized that combinations of the above may also be employed.

The wide color gamut format circuit 22 and the wide color gamut digital display interface 25 is logic that receives the wide gamut RGB indication information and wide gamut color format information 24 and provides the wide gamut confirmation information 26 in a format designated by the format definition information. The wide color gamut format logic may format the wide gamut RGB data by either formatting non-wide color data into wide gamut color information or outputting already formatting wide gamut color information.

The register might be accessible by the image source provider through the same link 16 or any other suitable link if desired. Alternatively, the register may be populated by a manufacturer of the wide color gamut digital display indicating the format(s) that the wide color gamut digital display can accommodate. It will be recognized that the register may be any suitable memory whether addressable or not addressable and may include multiple formats if the wide color gamut digital display can accommodate differing formats of wide color gamut RGB data.

Unlike other known systems, the system 10 actually displays wide gamut RGB data 26 that is received from an image source provider as opposed to, for example, merely changing a brightness level based on sent wide gamut RGB data. In addition, the system utilizes a wide color gamut digital display 14 to indicate wide gamut RGB indication information and format definition information for color data that is to be received in a multi-stimulus color space, such as an RGB color space or any other suitable color space.

Figure 2:
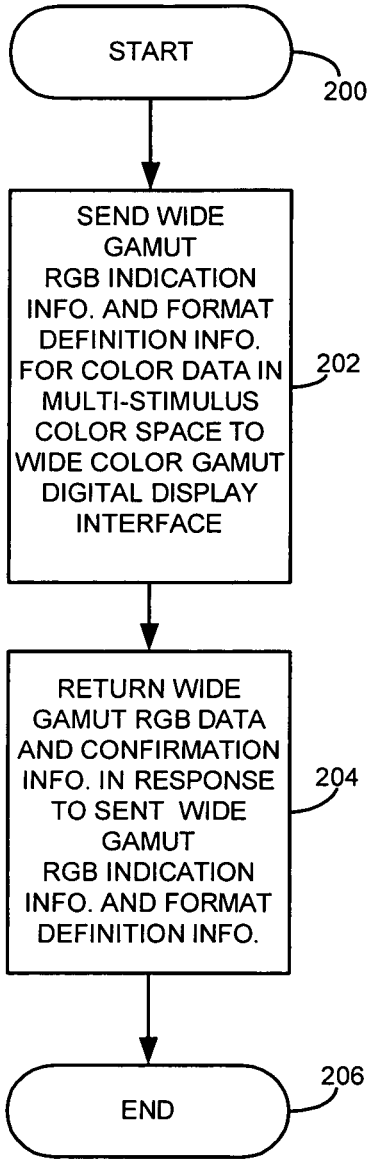
FIG. 2 is an example of a method for providing wide gamut RGB digital display.

FIG. 2 illustrates an example of a method that may be carried out, for example, by the system 10 which starts in block 200 where, for example, power may be applied to the system. As shown in block 202, the method includes indicating wide gamut RGB indication information and format definition information 24 for color data in a multi-stimulus color space to a wide color gamut digital display interface 25 in an image source provider. This may be done, for example, by the wide color gamut digital display 14, or any other suitable device. As shown in block 204, the method includes returning, by the image source provider 12, wide gamut RGB data and confirmation information 26 in response to the sent wide gamut RGB indication information and format definition information 24. The confirmation information may be sent every frame if desired and may change over time if the system changes to a different wide gamut display mode or non-wide gamut mode. Once this is done, then the wide gamut RGB data may then be displayed by display logic 28 and as shown in block 206. Stated another way, a method for providing wide gamut RGB image information includes indicating, to the image source provider 12, wide gamut RGB indication information 24 and wide gamut color format definition information and in response, receiving wide gamut confirmation information from the image source provider 12. The method also includes displaying the received wide gamut RGB color data that was received in response to the wide gamut RGB indication information and format definition information.

Figure 3:
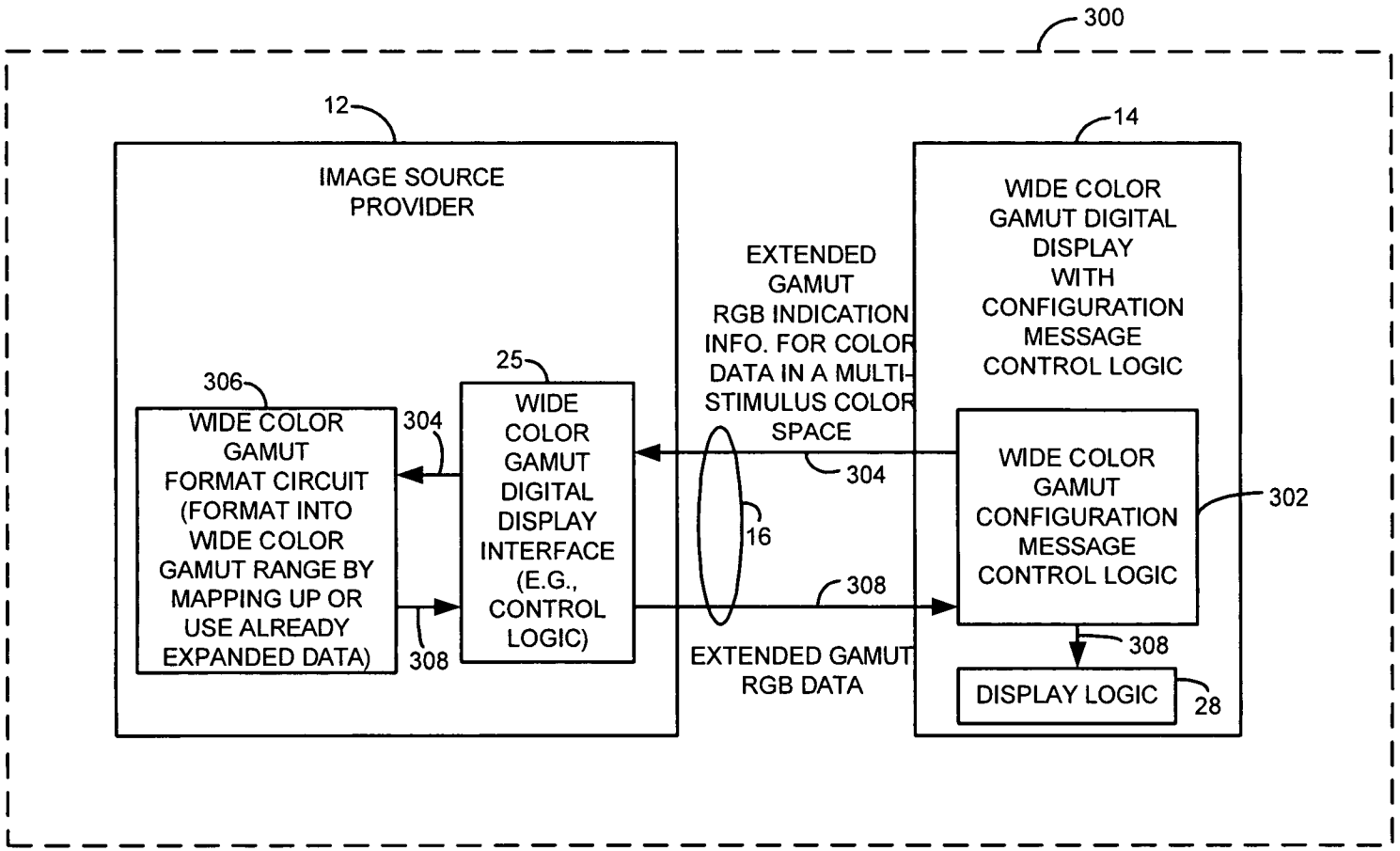
FIG. 3 is a block diagram illustrating another example of a wide gamut RGB digital display and image source provider in accordance with one example set forth in the disclosure.

FIG. 3 illustrates another example of an image processing system 300 similar to the image processing system 10 of FIG. 1 except that no format definition information needs to be sent nor is confirmation information returned from the image source provider. In this example, a wide color gamut configuration message control logic 302 is operative to indicate, to the image source provider 12, wide gamut RGB indication information, that indicates that wide gamut RGB color data is to be received in an wide multi-stimulus color space, such as an RGB color space. This indication information is shown as information 304. The image source provider, in response, insures that the wide color gamut format circuit provides the wide gamut RGB indication information. However, in this example, the wide color gamut format circuit 306 may have a default format and does not need to interpret any format definition information. The wide color gamut format circuit 306 provides wide gamut RGB color data 308 in response to the received wide gamut RGB indication information 304. The wide color gamut configuration message control logic may then suitably process or decode the information namely the wide gamut RGB data 308 as desired and output it to the display logic 28 that displays the received wide gamut RGB color data that was received in response to the wide gamut RGB indication information 304.

Figure 4:
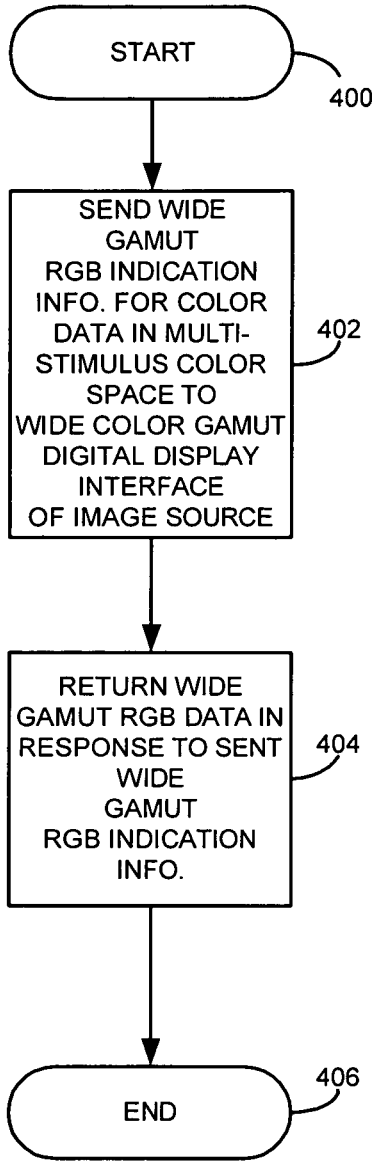
FIG. 4 is a flowchart illustrating another example of a method for providing wide gamut RGB color data among an image source provider and a wide color gamut digital display in accordance with one example set forth in the disclosure.

FIG. 4 illustrates one example of a method that may be carried out by the system 300 of FIG. 3. For example, as shown in block 400, the method may start at power up, for example, or other suitable time and as shown in block 402 the method includes indicating wide gamut RGB indication information 304 for color data and multi-stimulus color space to a wide color gamut digital display interface 25 of an image source provider 12. As shown in block 404, the image source provider 12 returns wide gamut RGB data 308 in response to the sent wide gamut RGB indication information 304. As in FIG. 1, the wide gamut RGB indication information indicates that the wide color gamut digital display 14 can accommodate wide gamut multi-stimulus color information such as wide gamut RGB color data. The method then may continue as shown in block 406 as required by the system 300.

The wide color gamut display 14 of FIG. 3, in this example indicates, to the image source provider 12, wide gamut RGB indication information 304 that indicates that wide gamut RGB color data is to be sent by the image source provider or received by the wide gamut RGB digital display in an wide multi-stimulus color space. The wide color gamut digital display then displays, by the wide gamut displays the received wide gamut RGB color data 308 that was received in response to the wide gamut RGB indication information.

Among other advantages, multiple embodiments are described wherein a wide color gamut digital display displays wide gamut color information based on indicating at least wide gamut RGB indication information to an image source provider. Additional information such as coding format definition information or other information may also be communicated from the wide color gamut digital display if desired. The wide color gamut digital display interface may be integrated as part of a digital display interface using, for example, DisplayPort, UDI, HDMI, LVDS, or DVI to enable an wide range of RGB values outside the normalized 0.0-1.0 range to be sent from an image source generation unit to a wide gamut display device. The display may support multiple coding formats or wide gamut display mode and uses a plug and play type operation to indicate this to the source provider. Other advantages will be recognized by those of ordinary skill in the art.

Also, integrated circuit design systems (e.g. work stations) are known that create make integrated circuits based on executable instructions stored on a computer readable memory such as but not limited to CDROM, RAM, other forms of ROM, hard drives, distributed memory etc. The instructions may be represented by any suitable language such as but not limited to hardware descriptor language or other suitable language. As such, the logic (e.g., circuits) described herein may also be produced as integrated circuits by such systems. For example an integrated circuit may be created for use in a display using instructions stored on a computer readable medium that when executed cause the integrated circuit design system to make an integrated circuit that is operative to indicate, to an image source provider, wide gamut RGB indication information and wide gamut color format definition information for wide gamut RGB color data to be received in a multi-stimulus color space; receive wide gamut confirmation information from the image source provider; and display received wide gamut RGB color data that was received in response to the wide gamut RGB indication information and wide color gamut format definition information. Integrated circuits having the logic that performs other of the operations described herein may also be suitable produced.

The above detailed description of the invention and the examples described therein have been presented for the purposes of illustration and description only and not by limitation. It is therefore contemplated that the present invention cover any and all modifications, variations or equivalents that fall within the spirit and scope of the basic underlying principles disclosed above and claimed herein.

What is claimed is:

1. A wide gamut RGB digital display comprising:

wide color gamut configuration message control circuit operative to indicate, to an image source provider, wide gamut RGB indication information that indicates that wide gamut RGB color data is to be received and wide color gamut format definition information representing a format of the wide gamut RGB color data that the display can display for wide gamut RGB color data to be received and operatively responsive to wide gamut confirmation information from the image source provider; and a circuit operative to display received wide gamut RGB color data that was received in response to the wide gamut RGB indication information and wide color gamut format definition information.

2. The wide gamut RGB digital display of claim 1 wherein the wide color gamut configuration message control circuit comprises a register containing data representing the wide color format definition information.

3. A system comprising:

a wide gamut RGB digital display and an image source provider, the wide gamut RGB digital display comprising:

wide color gamut configuration message control circuit operative to indicate, to the image source provider, wide gamut RGB indication information that indicates that wide gamut RGB color data is to be received and wide color gamut format definition information representing a format of the wide gamut RGB color data that the display can display for wide gamut RGB color data to be received in a multi-stimulus color space and operatively responsive to wide gamut confirmation information from the image source provider; and a circuit operative to display received wide gamut RGB color data that was received in response to the wide gamut RGB indication information and wide color gamut format definition information; and the image source provider comprising:

a circuit operative to receive the wide gamut RGB indication information and wide color gamut format definition information and to provide the wide gamut confirmation information in a format designated by the format definition information.

4. The system of claim 3 wherein the circuit operative to receive the wide gamut RGB indication information and wide color gamut format definition information and to provide the wide gamut RGB color data in a format designated by the wide color gamut format definition information further comprises:

wide color gamut digital display interface circuit and wide color gamut format circuit operative to provide the wide gamut confirmation information in a format designated by the wide color gamut format definition information by either formatting non-wide color data into wide gamut color information or outputting already formatted wide gamut color information.

5. A method comprising:

indicating, to an image source provider device, wide gamut RGB indication information that indicates that wide gamut RGB color data is to be received and wide color gamut format definition information representing a format of the wide gamut RGB color data that the display can display for wide gamut RGB color data to be received in a multi-stimulus color space;

receiving wide gamut confirmation information from the image source provider; and displaying, on a display, received wide gamut RGB color data that was received in response to the wide gamut RGB indication information and wide color gamut format definition information.

6. The method of claim 5 comprising accessing stored data representing the wide color gamut format definition information to provide the wide color gamut format definition information to the image source provider.

7. The method of claim 5 comprising:

receiving the wide gamut RGB indication information and wide color gamut format definition information; and providing the wide gamut confirmation information in a format designated by the wide color gamut format definition information.

8. The method of claim 7 comprising:

receiving the wide gamut RGB indication information; and providing the wide gamut confirmation information in response to the wide gamut RGB indication information.

9. An image source provider comprising:

a circuit operative to receive wide gamut RGB indication information that indicates that wide gamut RGB color data is to be received and wide color gamut format definition information representing a format of the wide gamut RGB color data that the display can display and to provide to a display wide gamut confirmation information in a format designated by the wide color gamut format definition information.

10. The image source provider of claim 9 wherein the circuit is operative to generate the wide gamut RGB color data in a format that includes an altered color chromaticity value for a range defined for a non-wide gamut range.

11. The image source provider of claim 9 wherein the circuit is operative to generate the wide gamut RGB color data in a format such that if a digital color value goes outside a normalized range, then it indicates a color outside of a non-wide gamut range.

12. A non-transitory computer readable medium comprising:

executable instructions stored thereon that when executed cause an integrated circuit design system to make an integrated circuit that is operative to:

indicate, to an image source provider, wide gamut RGB indication information that indicates that wide gamut RGB color data is to be received and wide color gamut format definition information representing a format of the wide gamut RGB color data that the display can display for wide gamut RGB color data to be received in a multi-stimulus color space;

receive wide gamut confirmation information from the image source provider; and display received wide gamut RGB color data that was received in response to the wide gamut RGB indication information and format definition information.

13. An integrated circuit made by a process of:

executing instructions stored on a computer readable medium that when executed cause an integrated circuit design system to make an integrated circuit that is operative to:

indicate, to an image source provider, wide gamut RGB indication information that indicates that wide gamut RGB color data is to be received and wide color gamut format definition information representing a format of the wide gamut RGB color data that the display can display for wide gamut RGB color data to be received in a multi-stimulus color space;

receive wide gamut confirmation information from the image source provider; and display received wide gamut RGB color data that was received in response to the wide gamut RGB indication information and wide color gamut format definition information.

* * * * *